US007820352B2

(12) United States Patent
Yamazaki et al.

(10) Patent No.: US 7,820,352 B2
(45) Date of Patent: Oct. 26, 2010

(54) IMAGE FORMING METHOD

(75) Inventors: Hiroshi Yamazaki, Tokyo (JP); Mikio Kouyama, Tokyo (JP); Ken Ohmura, Tokyo (JP)

(73) Assignee: Konica Monolta Business Technologies, Inc., Tokyo (JP)

( * ) Notice: Subject to any disclaimer, the term of this patent is extended or adjusted under 35 U.S.C. 154(b) by 408 days.

(21) Appl. No.: 11/938,819

(22) Filed: Nov. 13, 2007

(65) Prior Publication Data

US 2008/0160436 A1 Jul. 3, 2008

(30) Foreign Application Priority Data

Dec. 27, 2006 (JP) ..... 2006-351506

(51) Int. Cl.
*G03G 13/04* (2006.01)

(52) U.S. Cl. ..... 430/124.1; 430/109.1; 430/109.3; 430/109.4

(58) Field of Classification Search ..... 430/124.1, 430/109.1, 109.3, 109.4
See application file for complete search history.

(56) References Cited

U.S. PATENT DOCUMENTS

| | | | | |
|---|---|---|---|---|
| 6,183,869 | B1 * | 2/2001 | Okuda et al. | 428/411.1 |
| 7,491,481 | B2 * | 2/2009 | Koyama et al. | 430/109.3 |
| 2003/0134215 | A1 * | 7/2003 | Kashiwabara et al. | 430/108.4 |
| 2003/0224276 | A1 * | 12/2003 | Tsuji et al. | 430/109.3 |

* cited by examiner

*Primary Examiner*—Hoa V Le
(74) *Attorney, Agent, or Firm*—Lucas & Mercanti, LLP

(57) ABSTRACT

Image forming method comprising a step of fixing a toner image in a fixing device of a contact heating system, wherein the toner comprises a resin which comprises a polyester resin and a styrene-aryl resin and is formed by a process comprising allowing a polyvalent carboxylic acid and a polyvalent alcohol to condensation-polymerize in the presence of a styrene monomer and an acrylic acid ester monomer in an aqueous medium to form the polyester resin and allowing the styrene monomer and the acrylic acid ester monomer to radical-polymerize to form the styrene-acryl resin; the fixing device of a contact heating system comprises a heating roller and a belt-form pressure means.

8 Claims, 4 Drawing Sheets

IMAGE FORMING METHOD

FIELD OF THE INVENTION

The present invention relates to an image forming method.

BACKGROUND OF THE INVENTION

In the field of electrophotographic image forming techniques, high quality image formation enabling reproduction of micro-dot images or highly precise images are demanded with the advance of digital technologies. In response thereto, there have been studied minute-particle toners. There has been also noted a so-called polymerization toner which is feasible to control particle form or size in the stage of production.

A polymerization toner is constituted of toner particles obtained by coagulating toner constituent particles such as a particulate resin obtained by a process of polymerization (e.g., emulsion polymerization), colorant particles and optionally other particles.

As one of such particulate resins constituting a polymerization toner is cited particulate styrene-acryl resin. This particulate resin is formed by an emulsion polymerization process in which a polymerizable monomer as a raw material is dispersed in an aqueous medium containing an emulsifying agent to form oil droplets, after which emulsion polymerization is undergone by adding a polymerization initiator to perform radical polymerization within the droplets, as set forth in, for example JP-A Nos. 200-214629 and 2001-125313 (hereinafter, the term JP-A refers to Japanese Patent Application publication).

A styrene-acryl resin, which exhibits a relatively low softening point due to its non-crystalline structure, is suitably used for a toner which is desired to be fixed at a relatively low temperature, a so-called low-temperature fixable toner.

However, a toner using a styrene-acryl resin exhibits superior low temperature fixability but is inferior in fixing strength, having problems that when a force such as bending or abrasion is applied onto a fixed toner image on a transfer material, this influence renders it difficult to maintain a stable toner image. In response thereto, there has been attempted stabilization by curing a resin but sufficient effects have not been achieved.

There is also cited a toner using a polyester resin. Such a toner using a polyester resin has a higher softening point than a toner using a vinyl resin but exhibits sharp melting behavior and stable fixing strength even when creased or bent so that solid toner images are advantageously obtained.

In view of the foregoing, there has been studied development of a toner having advantages of both of a styrene-acryl resin and a polyester resin. For instance, there was studied a technique for preparing a toner by incorporating a styrene-acryl resin and a polyester resin through kneading and grinding. This technique attempted to prepare a toner having a hybrid structure composed of styrene-acryl resin and polyester resin by a process of mixing both resins, followed by melting, kneading and grinding, as set forth, for example, in JP-A 2001-125313.

Recently, reduction of energy consumption in image forming apparatuses is desired from the viewpoint of global environmental conservation and enhancement of fixing efficiency in a fixing device has been studied in addition to development of a toner corresponding to low-temperature fixing. As such a fixing device, there appeared an image forming apparatus provided with a fixing device composed of a roll-form heating body and a belt-form pressure body in place of the conventional combination of a heating roller and a pressure roller, as described in JP-A 10-228198.

SUMMARY OF THE INVENTION

However, when performing image formation using a ground toner composed of a polyester resin and a styrene-acryl resin in the foregoing image forming apparatus provided with a fixing device composed of a roll-form heating body and a belt-form pressure body, staining was observed on images with an increase in number of printed sheets. Specifically, in cases of a continuous large number of prints exceeding 10,000 sheets, staining on the heating roller surface was also marked and image staining due to fixing offset was markedly observed, and winding around the belt-form pressure body was also occurred when printing on both sides of a paper (duplex printing).

It is an object of the invention to provide an image forming method not causing image staining due to fixing offset by using a toner composing a styrene-acryl resin and a polyester resin in an image forming apparatus provided with a fixing device comprised of a heating roller and a belt-form pressure body.

Specifically, it is an object of the invention to provide an image forming method which can obtain superior prints without image staining even when performing continuous printing of a large amount exceeding 10,000 sheets of print and also can achieve superior image formation without causing winding onto the pressure belt side even in printing on both sides of a paper (or duplex printing).

The object of the invention can be realized by the following constitution.

One aspect of the invention is directed to an image forming method comprising forming a toner image on a support by using a toner comprising a resin and a colorant and fixing the formed toner image in a fixing device of a contact heating system, wherein the resin comprises a polyester resin and a styrene-aryl resin and is formed by a process comprising allowing a polyvalent carboxylic acid and a polyvalent alcohol to condensation-polymerize in the presence of a styrene monomer and an acrylic acid ester monomer in an aqueous medium to form the polyester resin and allowing the styrene monomer and the acrylic acid ester monomer to radical-polymerize to form the styrene-acryl resin; the fixing device of a contact heating system comprises a heating roller and a belt-form pressure means.

According to the invention, prints of no image stain can be provided when performing image formation by using a toner composing a styrene-acryl resin and a polyester resin and a fixing device comprised of a heating roller and a belt-form pressure body. Specifically even when performing continuous-printing of a large amount exceeding 10,000 sheets which often causes fixing offset, superior printing can be achieved.

Further, no winding onto the belt-form pressure means side occurred even when performing duplex printing.

The use of a toner composed of composite particles of a polyester resin and a styrene-acryl resin exhibits performance of both a polyester resin and a styrene-acryl resin, while achieving stable belt fixing. Specifically, a toner image exhibiting stable fixing strength is achieved by superior viscoelasticity of polyester resin and fixing at a lower temperature than a conventional one is realized by superior low-fixability of a styrene-acryl resin.

The hybrid resin particle, which are prepared by a specific polymerization process, have a uniform minute particle size, whereby a toner exhibiting a narrow distribution of electrostatic charge is obtained, enabling to achieve high-efficient toner image fixing by a fixing device of a belt system having a broad nip. The formed toner image can realize faithful reproduction of micro-dot images or fine-line images, enabling stable formation of high quality images fitting to digital images over long duration.

DETAILED DESCRIPTION OF THE INVENTION

Figure 1:
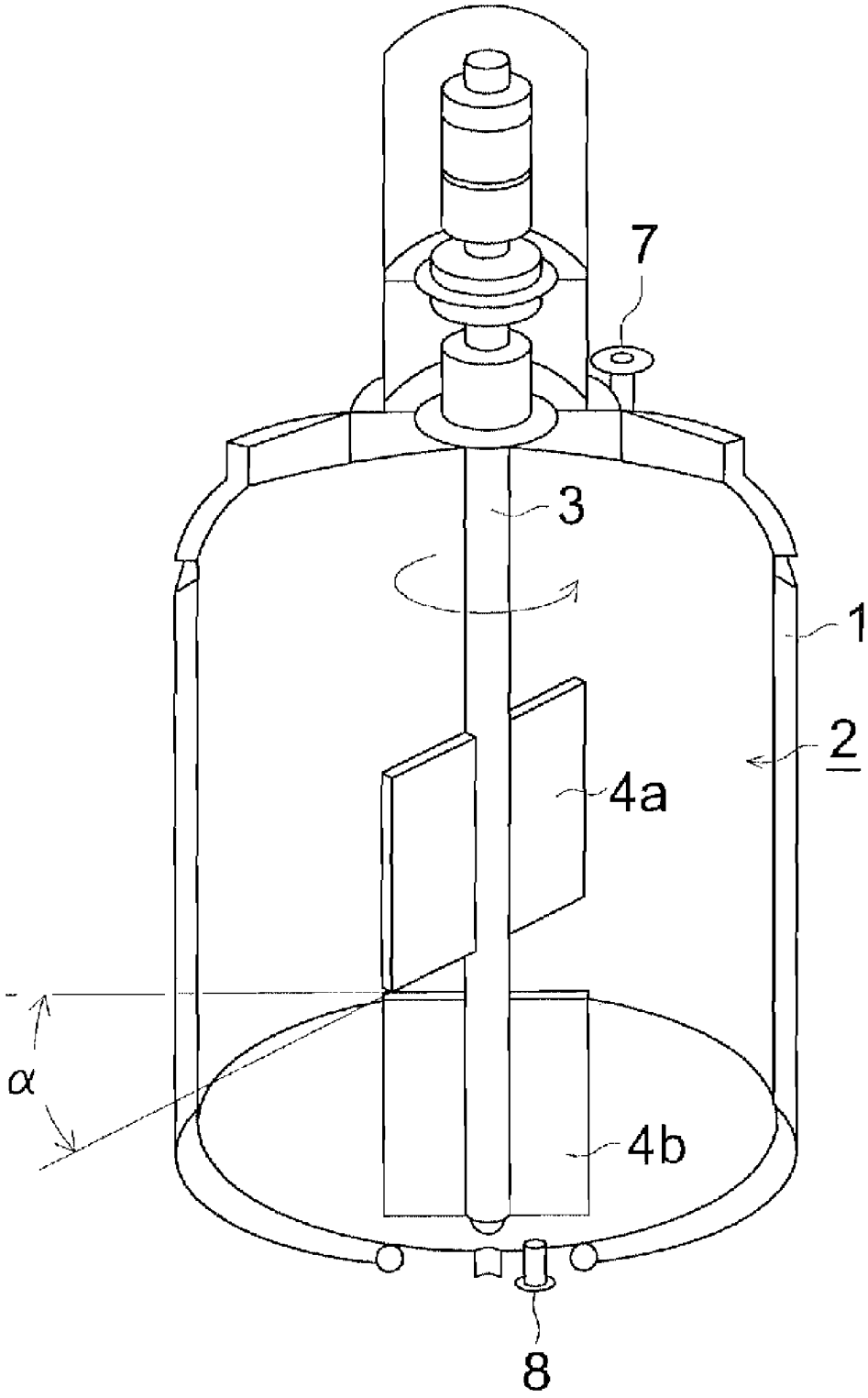
FIG. 1 is a perspective view showing an example of a reactor used for preparation of the toner of the invention.

The invention is related to an image forming method comprising a step of fixing a toner image developed by a toner containing a polyester resin and a styrene-acryl resin in a fixing device comprising a heating roller and a belt-form pressure means.

According to the invention, print making is achieved without causing image staining due to fixing offset when performing image formation by using a toner containing a polyester resin and a styrene-acryl resin and a fixing device provided with a heating roller and a belt-form pressure means.

The reason that conventional ground toners using a polyester resin and a styrene-acryl resin have not been as effective as in the invention is presumed to be due to dispersibility of the polyester resin and the styrene-acryl resin in the ground toner. It is presumed that conventional ground toners cannot achieve homogeneous dispersion of a polyester resin and a styrene-acryl resin at the level realized in the invention, which partially forms a low melt viscosity region. Accordingly, it is presumed that in a fixing device having a broad nip portion on the belt, such a low melt viscosity region is transferred onto the surface of the heating roller, causing fixing offset.

It is further presumed that in the invention, formation of finely homogeneous dispersion structure of a polyester resin and a styrene-acryl resin does not give rise to a low melt viscosity region in the toner so that even in a fixing device having a broad nip portion, homogeneously softening or melting is achieved and results in stable fixing.

There will be further detailed the invention.

Image Forming Method

The image forming method of the invention comprises the steps of developing a latent image formed on a photoreceptor with a developer comprising a toner to form a toner image, transferring the toner image onto a transfer material and fixing the toner image on the transfer material by using a fixing device of a contact heat fixing system, and further comprises the step of cleaning any toner remained on the photoreceptor.

Specifically, the image forming method comprises the steps of forming an electrostatic latent image formed on a photoreceptor, developing the latent image with a developer comprising a toner to be described later to form a toner image, transferring the toner image onto a transfer material by application of an electric field, fixing the transferred toner image on the transfer material by using a fixing device of a contact heating system and constituted of a heating roller and a belt-form pressure means, and cleaning a toner remained on the photoreceptor.

Toner

A toner for use in the image forming method of the invention is composed of a resin formed of hybrid resin particles comprised of a polyester resin and a styrene-acryl resin. The hybrid resin particles are formed in such a manner that a polyvalent carboxylic acid and a polyvalent alcohol are allowed to be included in oil-droplets containing styrene and an acrylic acid ester or methacrylic acid ester and polycondensation reaction is performed within the oil-droplets in an aqueous medium to form a polyester resin. After formation of a polyester resin, the foregoing polymerizable monomers are radical-polymerized to form a styrene-acryl resin, whereby hybrid resin particles having a size of approximately 100 nm and comprised of a polyester resin and a styrene-acryl resin are formed.

In the invention, a dehydration reaction between the carboxyl group of a polyvalent carboxylic acid and the hydroxyl group of a polyvalent alcohol is undergone within aqueous-dispersed oil-droplets formed of vinyl monomers of styrene and an acrylic acid ester to form a polyester resin. Thus, it is contemplated that polycondensation is performed employing a system capable of cutting water, which is formed of polymerizable vinyl monomers, whereby a polyester resin is assuredly formed even in an aqueous medium which tends to inhibit an esterification reaction.

Then, the hybrid resin particles composed of a polyester resin and a styrene-acryl resin are coagulated to form colored particles as a parent body of a toner and there is obtained a toner in which a polyester resin and a styrene-acryl resin are finely and homogeneously dispersed at a level not attainable by conventional ground toners. Thus, the toner used in the invention has realized uniform dispersion of a polyester resin and a styrene-acryl resin which differ in structure from each other and have been considered to be difficult to be uniformly dispersed and the use of hybrid resin particles at a level of 100 nm has achieved finely homogeneous dispersion.

Accordingly, a polyester resin or a styrene-acryl resin is not unevenly located within the toner, so that even when using a fixing device of high fixing efficiency, such as a fixing device of a belt system, uniform softening or melting is achieved and fixing can be stably performed without concerns of fixing offset.

Toners relating to the invention are a polymerization toner obtained by the preparation method described below and is comprised of toner particles formed by coagulation of hybrid resin particles including a polyester resin and styrene-acryl resin, and optionally of colorant particles.

Preparation of Toner

The method of preparing a toner relating to the invention comprises a dispersion step of dispersing a hybrid resin particle forming composition containing poly-condensable monomers comprised of a carboxylic acid having a valence of two or more (hereinafter, also denoted as a polyvalent carboxylic acid) and an alcohol having a valence of two or more (hereinafter, also denoted as a polyvalent alcohol) and radical-polymerizable monomers comprised of a styrene compound and an acrylic acid ester compound in an aqueous medium containing a surfactant of a compound formed of a long chain hydrocarbon group and an acidic group (hereinafter, also denoted as an acidic group containing surfactant) to form oil droplets dispersed in the medium; a polycondensation step of allowing the polyvalent carboxylic acid and the polyvalent alcohol to polycondensate within the droplets to form a polyester resin.; a polymerization step of allowing the radical-polymerizable monomers to copolymerize to form a styrene-acryl resin, thereby forming hybrid resin particles; and a coagulation step of allowing the hybrid resin particles to be coagulated with colorant particles in the aqueous medium to form a toner particles.

The preparation method of a toner, for instance, comprises:

(1) an oil-droplet formation step of mixing poly-condensable monomers of a polyvalent carboxylic acid and a polyvalent alcohol, and radical-polymerizable monomers of a styrene compound and a (meth)acrylic acid ester compound to prepare a hybrid resin forming composition and dispersing the hybrid resin forming composition in an aqueous medium containing an acidic group containing surfactant to obtain an aqueous dispersion of the hybrid resin forming composition in the form of oil-droplets dispersed in the medium;

(2) a polymerization step of subjecting the aqueous dispersion of the hybrid resin forming composition to polymerization to obtain a dispersion of hybrid resin particles;

(3) a coagulation step of allowing the hybrid resin particles, colorant particles and optionally toner component particles such as wax particles or charge-controlling agent particles to be coagulated and melted to obtain toner particles;

(4) a filtration and washing step of filtering off the toner particles from the aqueous medium and washing the toner particles to remove any surfactant and the like; and (5) a drying step of drying the washed toner particles; and the method may optionally further comprises (6) an external additive adding step of adding an external additive to the dried toner particles.

(1) Oil-Droplet Formation Step:

A hybrid resin particle forming composition which contains a polyvalent carboxylic acid, a polyvalent alcohol, a styrene compound and a (meth)acrylic acid ester compound is added to an aqueous medium containing an acidic group containing a surfactant at a concentration lower than the critical micell concentration and dispersed by employing mechanical energy to form oil-droplets.

Dispersing machines to perform dispersing oil-droplet by mechanical energy are not specifically limited and include, for example, a stirrer provided with a high-speed rotor, CLEARMIX (produced by M-Technique Co., Ltd.), an ultrasonic dispersing machine, a mechanical homogenizer, a Manton-Gaulin homogenizer and a pressure-type homogenizer.

The number average primary particle size of dispersed oil-droplets is preferably from 50 to 500 nm, and more preferably from 70 to 300 nm.

In the invention, the aqueous medium refers to a medium containing water in an amount of at least 50% by mass. As components other than water is cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

Acidic Group Containing Surfactant:

The acidic group containing surfactant which is used in the preparation method of toners relating to the invention is a compound containing a hydrophobic group formed of a long chain hydrocarbon group and a hydrophilic group formed of an acidic group.

The long chain hydrocarbon group refers to a hydrocarbon group having a main chain of at least 8 carbon atoms and examples of such a long chain hydrocarbon group include an alkyl group having 8 to 40 carbon atoms and an aromatic group which may be substituted, and a phenyl group which is substituted by an alkyl group of 8 to 30 carbon atoms is preferred.

An acidic group contained in the acidic group containing surfactant is preferably one exhibiting high acidity. Examples of such an acidic group include a sulfonic acid group, a carboxylic acid group and a phosphoric acid group, of which is preferred a sulfonic acid group.

Preferred examples of an acidic group containing surfactant include a sulfonic acid, carboxylic acid and a phosphoric acid, each containing a long chain hydrocarbon group. Specific examples thereof include sulfonic acids such as dodecylsulfonic acid, eicosylsulfonic acid, decylbenzenesulfonic acid, dodecylbenzenesulfonic acid and eicosylbenzenesulfonic acid; carboxylic acids such as dodecylcarboxylic acid; and phosphoric acids such as dodecylphosphoric acid and eicosylphosphoric acid. Of these, the foregoing sulfonic acids are specifically preferred.

The acidic group containing surfactant is one in which an acidic group and a long chain hydrocarbon group are combined through an inorganic group or an organic group and one in which an acidic group is directly combined with a long chain hydrocarbon group is preferred. The reason therefor is not clear but it is assumed that the structure of direct combination of a long chain hydrocarbon group as a hydrophobic group and an acidic group as a hydrophilic group realizes such a state that the acidic group is oriented to the aqueous medium (water phase) and the hydrophobic group i s oriented to oil-droplets composed of the hybrid resin forming composition, achieving stabilization of the oil-droplets and enabling efficient discharge of water formed in the polycondensation reaction to a water phase.

The acidic group containing surfactant is contained preferably at a concentration lower than the critical micelle concentration in an aqueous medium, whereby no micelle is formed in the aqueous medium, leading to stable formation of oil droplets. It is contemplated that since a surfactant does not exist in excess, the surfactant is adequately oriented around the stably formed oil-droplets. It is therefore presumed that such adequate orientation definitely functions as a catalyst for dehydration in the polycondensation reaction of the polymerization step, as described below, leading to an enhanced polycondensation reaction rate.

The concentration of an acidic group containing surfactant in an aqueous medium is preferably not more than the critical micelle concentration of the surfactant, and concretely, it is preferably not more than 80% of the critical micelle concentration, and still more preferably not more than 70%, but it is not specifically limited. The lower limit of the surfactant content may be an extent having come into effect as a catalyst in the polycondensation reaction to obtain a polyester resin. Specifically, the content of an acidic group containing surfactant is preferably from 0.01 to 2% by mass of the aqueous medium, and more preferably from 0.1 to 1.5% by mass.

The aqueous medium may further contain an appropriate anionic surfactant or nonionic surfactant to achieve stabilization of oil droplets composed of the hybrid resin forming composition.

Polyvalent Carboxylic Acid:

The hybrid resin forming composition for use in the preparation method of the toner relating to the invention includes a polyvalent carboxylic acid as a poly-condensable monomer. Examples of a polycarboxylic acid include dicarboxylic acids such as oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccenic acid, isododecenylsuccinic acid, n-octylsuccinic acid and n-octenylsuccinic acid; aromatic dicarboxylic acids such as phthalic acid, isophthalic acid, terephthalic acid, and naphthalenedicarboxylic acid; and carboxylic acid having a valence of 3 or more, such as trimellitic acid and pyromellitic acid.

Polycarboxylic acids may be used alone or in combination. The use of carboxylic acids having a valence of 3 or more, as a polyvalent carboxylic acid can obtain hybrid resin particles having a cross-linkage structure formed in the polymerization stage. The content of such a carboxylic acid having a valence of 3 or more is preferably from 0.1 to 10% by mass, based on the total polyvalent carboxylic acids.

Polyvalent Alcohol:

The hybrid resin forming composition for use in the preparation method of the toner of the invention, includes a polyvalent alcohol as a poly-condensable monomer. Examples of a polyvalent alcohol include diols such as ethylene glycol, diethylene glycol, triethylene glycol, 1,2-propylene glycol, 1,3-propylene glycol, 1,4-butane diol, 1,4-bytylene diol, neopentylene glycol, 1,5-pentanediol, 1,6-hexanediol, 1,7-heptanediol, 1,8-octanediol, 1,9-nonanediol, 1,10-decanediol, pinacol, cyclopentane-1,2-diol, cyclohexane-1,4-diol, cyclohexane-1,2-diol, cyclohexane-1,4-dimethanol, dipropylene glycol, dipropylene glycol, polyethylene glycol, polypropylene glycol, polytetramethylene glycol, bisphenol A, bisphenol Z and hydrogenated bisphenol A; polyvalent aliphatic alcohols having a valence of 3 or more, such as glycerin, trimethylolpropane, pentaerythritol, sorbitol, trisphenol PA, phenol novolac and cresol novolac; and an alkylene oxide adduct of a polyvalent alcohol having a valence of 3 or more, as described above.

Polyvalent alcohols are usable alone or in combinations thereof. The use of a polyvalent alcohol having a valence of 3 or more can obtain a polyester resin having a crosslinking structure. The proportion of polyvalent alcohols having a valence of 3 or more is preferably from 0.1% to 30% by weight, based on the total polyvalent alcohols.

The ratio of polyvalent alcohol to polyvalent carboxylic acid, which is represented by an equivalent ratio of a hydroxyl group [OH] of the polyvalent alcohol to a carboxyl group [COOH] of the polycarboxylic acid, i.e., expressed in [OH]/[COOH], is preferably in the range from 1.5/1 to 1/1.5, and more preferably from 1.2/1 to 1/1.2. A ratio of polyvalent alcohol to polyvalent carboxylic acid falling within the foregoing range can obtain a polyester resin having the targeted molecular weight.

The polycondensation composition may contain an extremely small amount of a monovalent carboxylic acid and/or monovalent alcohol, together with polyvalent carboxylic acids and polyvalent alcohols. Such a monovalent carboxylic acid and/or monovalent alcohol functions as a polymerization terminator in polycondensation of the oil-droplet, so that an addition amount thereof can control the molecular weight of the targeted polyester resin.

In the preparation method of the toner relating to the invention, the content of poly-condensable monomers is preferably from 10 to 90% by mass, and more preferably from 20 to 80% by mass, based on the whole of the hybrid resin forming composition. When the monomer content is not less than the lower limit of the foregoing range, the obtained toner can display sufficient viscoelasticity due to a polyester resin component and achieve sufficient fixability without causing fixing offset. When the monomer content is not more than the upper limit of the foregoing range, the obtained toner can display sufficient low-temperature fixability due to a styrene-acryl resin component without causing reduced fixability.

Styrene Compound:

Examples of a styrene compound which is contained in the hybrid resin forming composition used for the preparation method of the toner of the invention, include styrene monomers and styrene derivatives such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene.

To control the softening point and a glass transition temperature of a styrene-acryl resin, the styrene compound content is not specifically limited but preferably from 40 to 95% by mass and more preferably from 50 to 80% by mass, based on the total amount of radical-polymerizable monomers.

Acrylic Acid Ester Compound:

Examples of a (meta)acrylic acid ester compound which is contained in the hybrid resin forming composition used for the preparation method of the toner of the invention, include methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

To control the softening point and a glass transition temperature of a styrene-acryl resin, the content of a (meta) acrylic acid ester compound is not specifically limited but preferably from 5 to 60% by mass and more preferably from 10 to 50% by mass, based on the total amount of radical-polymerizable monomers.

Further, radical-polymerizable monomers may contain a compound having an ionically dissociating group. The compound having an ionically dissociating group is one which contains a substituent such as a carboxyl group, a sulfonic acid group or a phosphoric acid group, as a constituent group of the monomer. Specific examples thereof acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, and 3-chloro-2-acid phosphoxypropyl methacrylate.

Further, radical-polymerizable monomers may contain a polyfunctional vinyl compound. The polyfunctional vinyl compound is a compound containing at least two unsaturated bonds and examples thereof include divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate. The polyfunctional vinyl compounds may used alone or in combination. Radical-polymerizable monomers containing a polyfunctional vinyl compound can form a cured styrene-acryl resin in the radical copolymerization stage of the polymerization step.

The content of a polyfunctional vinyl compound can be chosen, depending on elasticity required in the obtained styrene-acryl resin but is preferably from 0.01 to 10% by mass, and more preferably from 0.02 to 5% by mass, based on total radical-polymerizable monomers. When the content of a polyfunctional vinyl compound is less than the upper limit of the foregoing range, the cross-linking rate of the formed styrene-acryl resin is moderately cross-linked and exhibits a softening point at a moderate level, resulting in no lowering of toner fixability. When the content of a polyfunctional vinyl compound is more than the upper limit of the foregoing range, a cross-linking structure portion is sufficiently attained and cross-linking effects are sufficiently achieved.

The hybrid resin particle-forming composition used in the preparation method of the toner relating to the invention, which produces radicals initiating radical copolymerization within oil-droplets, may contain a polymerization initiator.

There are usable oil-soluble polymerization initiators as a polymerization initiator. Examples of oil-soluble polymerization initiators include azo-type or diazo-type polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxy-cyclohexane)propane, and tris-(t-butylperoxy)triazine; polymer initiators having a peroxide in the side chain; and the like.

Together with an oil-soluble polymerization initiator contained within oil-droplets, a water-soluble polymerization initiator may be contained in the aqueous medium and radicals initiating radical copolymerization can be generated in the aqueous medium and supplied to the oil-droplets, concurrently with radical formation within the oil-droplets. Examples of a water-soluble polymerization initiator include persulfates such as potassium persulfate and ammonium persulfate, azobisaminodipropane acetate, azobiscyanovaleric acid and its salts, and hydrogen peroxide. Alternatively, a polymerization initiator is not contained within oil-droplets but a water-soluble polymerization initiator is contained in the aqueous medium, and polymerization-initiating radicals are generated only in the aqueous medium and supplied to the oil-droplets.

In the preparation method of the toner relating to the invention, the content of radical-copolymerizable monomers is preferably from 10 to 90% by mass, and more preferably from 20 to 80% by mass, based on the hybrid resin particle-forming composition. When the content is not less than the lower limit of the foregoing range, low temperature fixability due to the styrene-acryl resin component is sufficiently attained and when the content is not more than the upper limit of the foregoing range, viscoelasticity due to the polyester resin component can be sufficiently attained without causing toner offset.

Organic Solvent:

The hybrid resin particle-forming composition may contain various oil-soluble components such as an organic solvent. As such an organic solvent is cited toluene or ethyl acetate which exhibits a low boiling point and a low solubility in water.

The hybrid resin particle-forming composition may contain a colorant or wax. Performing polymerization of the hybrid resin particle-forming composition containing a colorant or wax can obtain colored or wax-containing hybrid resin particles. The wax content is usually from 2 to 20% by mass, preferably from 3 to 18% and more preferably from 4 to 15% by mass, based on the hybrid resin particle-forming composition.

(2) Polymerization Step:

In the polymerization step are performed a polycondensation step in which a polyvalent carboxylic acid and a polyvalent alcohol are polycondensated within the oil-droplets dispersed in the aqueous medium to form a polyester resin, and a radical copolymerization step in which a styrene compound and a (meta)acrylic acid ester compound are radical-copolymerized to form a styrene-acryl resin; and the polyester resin and the styrene-acryl resin are high-homogeneously mixed to obtain hybrid resin particles.

(2-1) Polycondensation Step:

In the polycondensation step, acidic group-containing surfactant molecules are arranged on the surface of the formed oil-droplet, while allowing a hydrophilic group of an acidic group to be orientated toward the water phase and a hydrophobic group of a long chain hydrocarbon group to orientate toward the oil phase. The acidic group existing in the interface between an oil-droplet and the water phase displays a catalytic effect on dehydration to remove water formed in polycondensation from the oil-droplet. As a result, it is assumed that polycondensation accompanying dehydration proceeds in the oil-droplet existing in the aqueous medium.

The polymerization temperature to perform polycondensation, depending on the kinds of a polyvalent carboxylic acid and a polyvalent alcohol contained in the polymerization composition, is usually 40° C. or more, preferably from 50 to 150° C., and more preferably from 50 to 100° C. for the purpose of being lower than the boiling point of water in the aqueous medium. The polymerization time, depending on the reaction rate of polycondensation to form polyester resin particles, is usually from 4 to 10 hr.

Polyester resin obtained in the polycondensation step exhibits a weight-average molecular weight (Mw) of 10,000 or more, preferably from 20,000 to 10,000,000, and more preferably from 30,000 to 1,000,000. The molecular weight (Mw) can be determined in gel permeation chromatography (GPC). A weight-average molecular weight falling within the foregoing range can inhibit the offset phenomenon occurred in the fixing stage at a relative high temperature in the toner image forming process.

Polyester resin obtained in the polycondensation step exhibits a number-average molecular weight (Mn) of 20,000 or more, preferably from 1,000 to 10,000, and more preferably from 2,000 to 8,000. The molecular weight (Mn) can be determined in gel permeation chromatography (GPC). A weight-average molecular weight falling within the foregoing range can achieve low-temperature fixability in the fixing stage of image formation using the toner and also achieves desired glossiness of images obtained in the image formation using a color toner.

The polyester resin preferably exhibits a glass transition temperature of 20 to 90° C. and a softening point of 80 to 220° C., and more preferably a glass transition temperature of 35 to 65° C. and a softening point of 80 to 150° C. The glass transition point is determined employing the on-set method at the second temperature-raising stage of a differential thermal analysis method, while the softening point can be determined employing an elevated type flow tester.

(2-2) Radical Copolymerization Step

In the radical copolymerization step, the radical copolymerization reaction is initiated by radicals formed by an initiator included in the formed oil-droplets or by supplying radicals formed by an initiator contained in the aqueous medium to the oil-droplets.

The polymerization temperature to perform radical copolymerization, depending on a styrene compound or a (meta) acrylic acid ester compound contained in the hybrid resin particle forming composition or the kind of a radical-forming polymerization initiator, is preferably from 50 to 100° C. more preferably from 55 to 90° C. The polymerization time, depending on the reaction rate of radical copolymerization to synthesize a styrene-acryl resin is usually from 5 to 12 hrs.

A styrene-acryl resin obtained in the radical copolymerization step preferably exhibits a weight average molecular weight (Mw) of 2,000 to 1,000,000 or a number average molecular weight (Mn) of 1,000 to 100,000. The weight average molecular weight (Mw) and the number average molecular weight (Mn) can be determined by gel permeation chromatography (GPC). The molecular weight distribution (Mw/Mn) is preferably from 1.5 to 100, and more preferably from 1.8 to 70. The use of a toner having a weight average molecular weight (Mw), a number average molecular weight (Mn) and a molecular weight distribution (Mw/Mn) falling with the foregoing range can inhibit the offset phenomenon occurred in the fixing stage of the image formation process.

A styrene-acryl resin obtained in the radical copolymerization step preferably exhibits a glass transition temperature of 30 to 70° C. and a softening point of 80 to 170° C. A glass transition temperature and a softening point falling within the foregoing range can achieve superior fixability.

In the polymerization step, for example, first, polycondensation is performed to form a polyester resin and after completion thereof, radical copolymerization reaction is initiated in the presence of the formed polyester resin.

(3) Coagulation Step:

In the coagulation step, a dispersion of hybrid resin particles obtained in the polymerization step (2) and a dispersion of colorant particles and optionally, particles of toner constituents such as wax, a charge controlling agent or the like, are mixed to prepare a dispersion used for coagulation. Subsequently, the hybrid resin particles and the colored microparticles are coagulated and thermally fused in an aqueous medium to form a dispersion of toner particles.

More specifically, to the coagulation dispersion is added a coagulant at a concentration more than the critical coagulation concentration to cause salting out. Concurrently, while stirring in a reactor provided with a stirring mechanism having a stirring blade (as shown, for example, in FIG. 1), the coagulated particles are thermally fused to form coalesced particles and grow the particles at a temperature higher than the glass transition temperature of the polyester resin and that of the styrene-acryl resin. When reaching the intended particle size, a large amount of water is added thereto to terminate the particle growth. Further heating and stirring smooth the particle surface to control the particle shape to form targeted toner particles.

Concurrently with a coagulant, an organic solvent infinitely soluble in water may be added to the dispersion for coagulation. Further, coagulating aids such as hydrated lime, bentonite, fly ash or kaolin may be used.

Examples of a wax forming wax particles include hydrocarbon waxes such as a low molecular weight polyethylene wax, a low molecular weight polypropylene wax, Fischer-Tropsch wax, microcrystalline wax and paraffin wax; and ester waxes such as carnauba wax, pentaerythritol behenic acid ester and citric acid behenyl. These may be used alone or in combination. The wax content is preferably from 20 to 25% by weight, based on all of the toner, more preferably 3% to 18% by weight, and still more preferably from 4% to 15% by weight.

Coagulants usable in the invention are not specifically limited but those chosen from metal salts are suitably usable. Such metal salts are salts of monovalent metals such as an alkali metal, e.g., sodium, potassium and lithium, salts of divalent metals, e.g., calcium, magnesium, manganese and copper; and salts of trivalent metals, e.g., iron and aluminum. Specific examples thereof include sodium chloride, potassium chloride, lithium chloride, calcium chloride, magnesium chloride, zinc chloride, copper sulfate, magnesium sulfate and manganese sulfate. Of these, salts of divalent metals are preferred. Coagulation can be achieved using a divalent metal salt at a relatively small amount. The above-described metal salts may be used alone or in combination.

A coagulant is added to a dispersion for coagulation in an amount of more than the critical coagulation concentration, preferably at least 1.2 times critical coagulation concentration and more preferably at least 1.5 time critical coagulation concentration.

The critical coagulation concentration which is a measure with respect to stability of an aqueous dispersion, is the concentration at which coagulation is caused. The critical coagulation concentration varies greatly with the component of dispersed particles. The critical coagulation concentration can be precisely determined according to techniques described in, for example, S. Okamura et al., Kobunshi Kagaku (Polymer Chemistry) 17, 601 (1960), edited by Kobunshi-Gakkai. Alternatively, while adding an intended salt to an objective dispersion for coagulation with varying the concentration thereof, the ζ-potential of the dispersion is measured and the salt concentration at which the potential changes is determined as the critical coagulation potential.

Organic solvents infinitely soluble in water, usable in the invention are chosen from ones which do not dissolve ester resin. Specific examples thereof include methanol, ethanol, 1-propanol, 2-propanol, ethylene glycol, glycerin and acetone, and alcohols having not more than three carbon atoms is preferred, for example, methanol, ethanol, 1-propanol, and 2-propanol, and 2-propanol is specifically preferred. These solvents are added preferably in an amount of 1% to 100% by volume, based on a dispersion before adding a coagulant.

In the process of coagulation, the standing time after adding a coagulant (until staring heating) is preferably as short as possible. More specifically, after adding a coagulant, heating the dispersion is started as soon as possible to reach a temperature higher than the glass transition temperature of polyester resin particles. The reason therefor is not clear, but producing problems such that the coagulation state of particles varies with elapse of standing time and the particle size distribution of toner particles becomes unstable or the surface property varies. The standing time is usually 30 min. or less, and preferably 10 min. or less. The temperature for adding a coagulant is not specifically limited but is preferably lower than the glass transition temperature of the used polyester resin particles.

In the process of coagulation, the temperature is preferably raised promptly by heating and the temperature-raising rate is preferably 1° C./min or more. The upper limit of the temperature-raising rate is not limited but is preferably 15° C./min or less in terms of inhibiting production of coarse particles due to propagation of rapid fusion. Furthermore, after reaching a temperature higher than the glass transition temperature, it is preferable to maintain the dispersion at that temperature to continue fusion. Thereby, growth of toner particles (coagulation of polyester resin particles and colored microparticles) and fusion (disappearance of the interface between particles) effectively proceed, leading to enhanced durability of finally obtained toner particles.

A colorant particle dispersion can be prepared by dispersing a colorant in an aqueous medium. A treatment of dispersing a colorant is conducted at a surfactant concentration higher than the critical micelle concentration in the aqueous medium. Dispersing machines used for dispersing colorants are not specifically limited but those described in the foregoing step (1) are usable. Surfactants usable in the invention are not specifically limited but anionic surfactants, for example, those described below are suitable.

Examples of an anionic surfactant include sulfonates such as sodium dodecylsulfonate, sodium dodecybenzenesulfonate, sodium arylalkylpolyether-sulfonate3,3-disulfondiphenylurea-4,4-diazo-bis-amino-8-naphthol-6-sulfonate, and sodium 2,2,5,5-tetramethyl-triphenylmethane-4,4-diazo-bis-β-naphthol-6-sulfonate; sulfonates such as sodium dodecylsulfonate, sodium tetradecylsulfonate, sodium pentadecylsulfonate, and sodium octylsulfonate; fatty acid salts such as sodium oleate, sodium laurate, sodium caprate, sodium caprylate, sodium caproate, potassium stearate, and calcium oleate.

Optionally employed as colorants, which are used in the present invention, are carbon black, magnetic materials, dyes, and pigments. Employed as carbon blacks are channel black, furnace black, acetylene black, thermal black, and lamp black. Employed as ferromagnetic materials may be ferromagnetic metals such as iron, nickel, cobalt, and the like, alloys comprising these metals, compounds of ferromagnetic metals such as ferrite and magnetite, alloys which comprise no ferromagnetic metals but exhibit ferromagnetism upon being thermally treated such as Heusler's alloys such as manganese-copper-aluminum, manganese-copper-tin, and the like, and chromium dioxide.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, and the same 60, and mixtures thereof may be employed. The number average primary particle diameter varies widely depending on their types, but is preferably between about 10 and about 200 nm.

Charge controlling agents to constitute charge controlling agent particles which are commonly known in the art and are dispersible in an aqueous medium, are usable in the invention. Specific examples thereof include Nigrosine dyes, metal salts of naphthenic acid or higher fatty acids, alkoxylated amines, quaternary ammonium compounds, azo metal complexes, and a salicylic acid metal salt and its metal complex. Dispersed charge controlling agent particles have a volume median diameter of 10 to 500 nm.

In preparation of toner particles obtained by allowing hybrid resin particles to be coagulated and fused in an aqueous medium, a laminar flow is formed within the reactor and the temperature, rotation number and time in the coagulation stage are controlled using a stirring blade and a stirring vessel which are capable of rendering a uniform internal temperature distribution, whereby a prescribed shape factor and high uniformity in shape distribution can be attained. The reason of obtaining high uniformity in shape distribution is presumed to be that when the coagulation step is performed in the field of forming a laminar flow, strong stress is not applied to coagulated particles in the process of coagulating and fusing and the temperature distribution within the stirring vessel becomes uniform under an accelerated laminar flow, resulting in coagulated particles of uniform shape distribution. Further, coagulated particles are gradually rounded by heating and stirring in the shape control stage, whereby the shape of the obtained toner particles can be optimally controlled.

In the preparation of a toner composed of toner particles by allowing hybrid resin particles to be coagulated and fused, a reactor provided with a stirring blade and a stirring bath, for example, as shown in FIG. 1 is cited as suitable one.

The reactor shown in FIG. 1 has a feature that stirring blades of multistage constitution are installed, in which the upper stirring blade is provided in advance at a crossing angle of α in the rotational direction to the lower stirring blade and no block such as a baffle, causing a turbulent flow is provided within the stirring vessel.

FIG. 1 is a perspective view showing an example of a reactor used for preparation of the toner of the invention.

In the reactor shown in FIG. 1, the rotation shaft (3) is vertically provided at the central portion of vertically cylindrical stirring vessel provided with a jacket for heat exchange (1) on the periphery. The lower stirring blade (4*b*) is positioned close to the bottom of the vessel (2) and attached to the shaft (3) and further on the upper side, the upper stirring blade (4*a*) is provided. The upper stirring blade (4*a*) is in advance to the lower stirring blade (4*b*) at a crossing angle of α in the rotational direction. The arrow indicates the rotation direction, numeral 7 designates an upper material charging inlet and numeral 8 designates an lower material charging inlet.

In the preparation method of toners of the invention, the crossing angle between stirring blades 4*a* and 4*b* is preferably less than 90°. The lower limit of the crossing angle is not specifically limited. A crossing angle of not less than 5° and less than 90° is preferred and a crossing angle of not less than 10° and less than 90° is more preferred.

In such a constitution, a dispersion to be coagulated is first stirred by the stirring blade (4*a*) provided on the upper side to form a flow toward the lower side. Subsequently, the flow formed by the stirring blade (4*a*) of the upper side is accelerated toward the lower direction by the stirring blade (4*b*) provided on the lower side. Simultaneously, a downward flow is separately formed by the upper stirring blade (4*a*) and it is assumed that the overall flow acceleratingly proceeds.

The form of the stirring blade is not specifically limited, unless a turbulent flow is to be formed therein. A stirring blade formed of the continuous surface having no throughhole, for example, in the form of a rectangular plate shown in FIG. 1, is preferred. The stirring blade may also be formed of a curved surface.

The stirring blade forms no turbulent flow, whereby coalescence of polyester resin particles is caused in the polymerization step and no re-dispersion due to destruction of particles occurs. Excessive collision of particles is inhibited in the coagulation step, resulting in enhanced uniformity in particle size distribution and leading to toner particles of uniform particle size distribution. Further, excessive coalescence of particles is inhibited, whereby toner particles of a uniform shape can be obtained.

(4) Filtration and Washing Step:

In the solid/liquid separation and washing step, toner particles are separated through solid/liquid separation from the toner particle dispersion obtained in the foregoing coagulation step and the separated toner cake (an aggregate in a cake form) is subjected to a washing treatment to remove attachments such as surfactants or coagulants from the toner particles. The foregoing solid/liquid separation and washing is conducted by centrifugal separation, reduced pressure filtration using a Nutsche funnel, or filtration by using a filter press, but is not specifically limited.

(5) Drying Step:

In the drying step, the thus washed toner particles are subjected to a drying treatment. Drying machines such as a spray dryer, vacuum free-dryer or a reduced pressure drying machine can be employed. The moisture content of dried toner particles is preferably not more than 1.0% by weight, and more preferably not more than 0.5% by weight.

The moisture content can be determined by the Karl Fischer method. Specifically, toner particles are allowed to stand for 24 hr. under a high temperature and high humidity environment of 30° C. and 85% RH and then measured using a moisture content measurement apparatus AQS-724 (produced by Hiranuma Sangyo Co., Ltd.) at a sample-heating temperature of 110° C. under sample humidity conditioning at 30° C. and 85% RH. The thus measured moisture content is defined as a moisture content of a toner.

When dried toner particles aggregated through a weak attractive force between particles to form a aggregate, the aggregate may be subjected to a disintegration treatment. There are usable mechanical disintegrating apparatuses such as a jet mill, a Henschel mixer, a coffee mill or a food processor.

(6) External Additive-Incorporating Step:

In the step of adding external additives, external additives are incorporated to the dried toner particles to improve fluidity or an electrostatic property and to enhance cleaning capability. Examples of a device used for adding external additives include a turbulent mixer, Henschel mixer, a Nauta mixer or a V-type mixer.

External additives usable in the invention are not specifically limited and various kinds of inorganic particles, organic particle and lubricants are usable. For instance, inorganic particles of silica, titania or alumina are preferably used and these inorganic particles are preferably subjected to a treatment for hydrophobicity, using a silane coupling agent or a titanium coupling agent.

An extent of the treatment for hydrophobicity is not specifically limited but the treatment is applied preferably to a level of methanol-wettability of 40 to 95. The methanol-wettability is a measure of wettability with methanol and measure as follows. 0.2 g of inorganic particles to be measured is weighed out and added into 50 ml of distilled water in a 200 ml beaker. Methanol is gradually added with slowly stirring from a burette whose top is dipped in liquid until the entire inorganic particles are wetted. The degree of hydrophobicity is determined by the following equation:

$$\text{Degree of hydrophobicity}=[a/(a+50)]\times 100$$

wherein "a" is the amount (ml) of methanol necessary to completely wet inorganic particles.

External additive are incorporated preferably at 0.1-5.0% by weight, and more preferably 0.5-4.0% by weight. Various combinations of external additives are feasible.

Toner Particle Size:

The toner obtained by the preparation method described above comprises toner particles, which preferably exhibit a volume-based median diameter ($D_{50}$) of from 3 to 8μm. The toner particle size can be controlled by a concentration of a coagulating agent or an addition amount of an organic solvent and a coagulation time in the coagulation step, and the composition of a polyester resin. A volume-based median diameter ($D_{50}$) from 3 to 8 μm reduces adhesive particles which traveled to the heating roller and adhere thereto, often causing offset, and results in an enhanced transfer efficiency, leading to enhanced image quality of halftone images and enhanced image quality of fine lines or dots.

The volume-based median diameter ($D_{50}$) is measured according to the procedure described below.

The volume-based median diameter ($D_{50}$) of toner particles can be determined using Coulter Multisizer 3 (Beckmann Coulter Co.), connected to a computer system for data processing.

The measurement procedure is as follows: 0.02 g of toner particles are added to 20 ml of a surfactant solution (for example, a surfactant solution obtained by diluting a surfactant containing neutral detergent with pure water to a factor of 10) and dispersed by an ultrasonic homogenizer to prepare a toner dispersion. Using a pipette, the toner dispersion is poured into a beaker having ISOTON II (produced by Beckman Coulter Co.) within a sample stand, until reaching a measurement concentration of 7%. The measurement particle count number was set to 25000 to perform measurement. Then aperture diameter of the Multisizer 3 was 50μm. The measurement range of 1 to 30μm was divided to 256 portions to determine the frequency number. The particle size corresponding to 50% of a volume-integrated fraction from the larger particles is defined as a volume-based median diameter.

Developer

When using the toner relating to the invention as a single-component developer by incorporating a magnetic material or as a two-component developer by mixing a so-called carrier, a nonmagnetic toner can be used alone. The toner can be suitably used for each of them. It is preferred to use the toner as a two-component developer by mixing a carrier, which can easily provide high quality images.

There are usable commonly known materials as a carrier constituting a two-component developer, including, for example, metals such as iron, ferrite and magnetite, and alloys of a metal such as aluminum or lead. Of these, ferrite particles are preferred.

The volume-based median diameter ($D_{50}$) of a carrier is preferably 15 to 100 μm, and more preferably 25 to 60μm. The volume-based median diameter ($D_{50}$) of the carrier can be determined using a laser diffraction type particle size distribution measurement apparatus provided with a wet disperser, HELOS (produced by SYMPATEC Corp.).

Preferred carriers include resin-coated carrier in which the surface of magnetic particles is covered with resin and a resin dispersion type carrier in which magnetic particle are dispersed in resin. Resins constituting the resin coated carrier are not specifically limited but an olefin resin, a styrene resin, a styrene/acryl resin, a silicone resin, an ester resin, and a fluorine-containing polymer resin are usable. Resins constituting the resin dispersion type carrier are not specifically limited but a polyester resin, a fluororesin, and a phenol resin are usable.

Contact Heat-Fixing Device:

There will be described a fixing device of a contact heating system, usable in the image forming method.

The fixing device of a contact heating system is constituted of a heating roller and a belt-form heating means.

The constitution thereof is not specifically limited so long as a belt-form heating means is in contact with a heating roller, forming a nip portion of a given width.

FIGS. 2*a* and 2*b* illustrate an example of a contact-heating fixing device having a heating roller and a belt-form heating means.

In FIGS. 2*a* and 2*b*, numeral 1 designates a contact-heating fixing device, numeral 2 designates a heating roller, numeral 3 designates a belt-form pressure means, numeral 4 designates a heat source, numeral 5 designates a tension roller, numeral 6 designates a pressure member and designation N is a nip portion.

FIG. 2*a* illustrates a structure of a heating roller being pressed to a belt-form pressure means. The nip width depends on its structure and pressure.

FIG. 2*b* illustrates a structure of a belt-form heating means being pressed to a heating roller by a pressure member.

A heating roller, which is heated by a heating member, preferably is one which heat--resistant and exhibits capability of being released from a melt toner.

Specific examples of a heating roller include a metal cylinder constituted of iron or aluminum coated with polytetrafluoroethylene or tetrafluoroethylene-perfluoroalkoxyvinyl ether copolymer and having a heat source in the interior of the cylinder.

A belt-form pressure means preferably is a seamless pressure belt exhibiting heat resistance, flexibility and releasing capability.

Specific examples of a pressure belt include a triple layer structure having a surface layer of PFA (perfluoroalkoxy) tube, an elastic silicone rubber layer on the polyimide substrate, and a double layer structure of a substrate of a polyester, polyperfluoroalkyl vinyl ether, a polyimid or polyether imide, which is covered with a releasing material layer of a fluorinated resin added with a conducting material.

Figure 3:
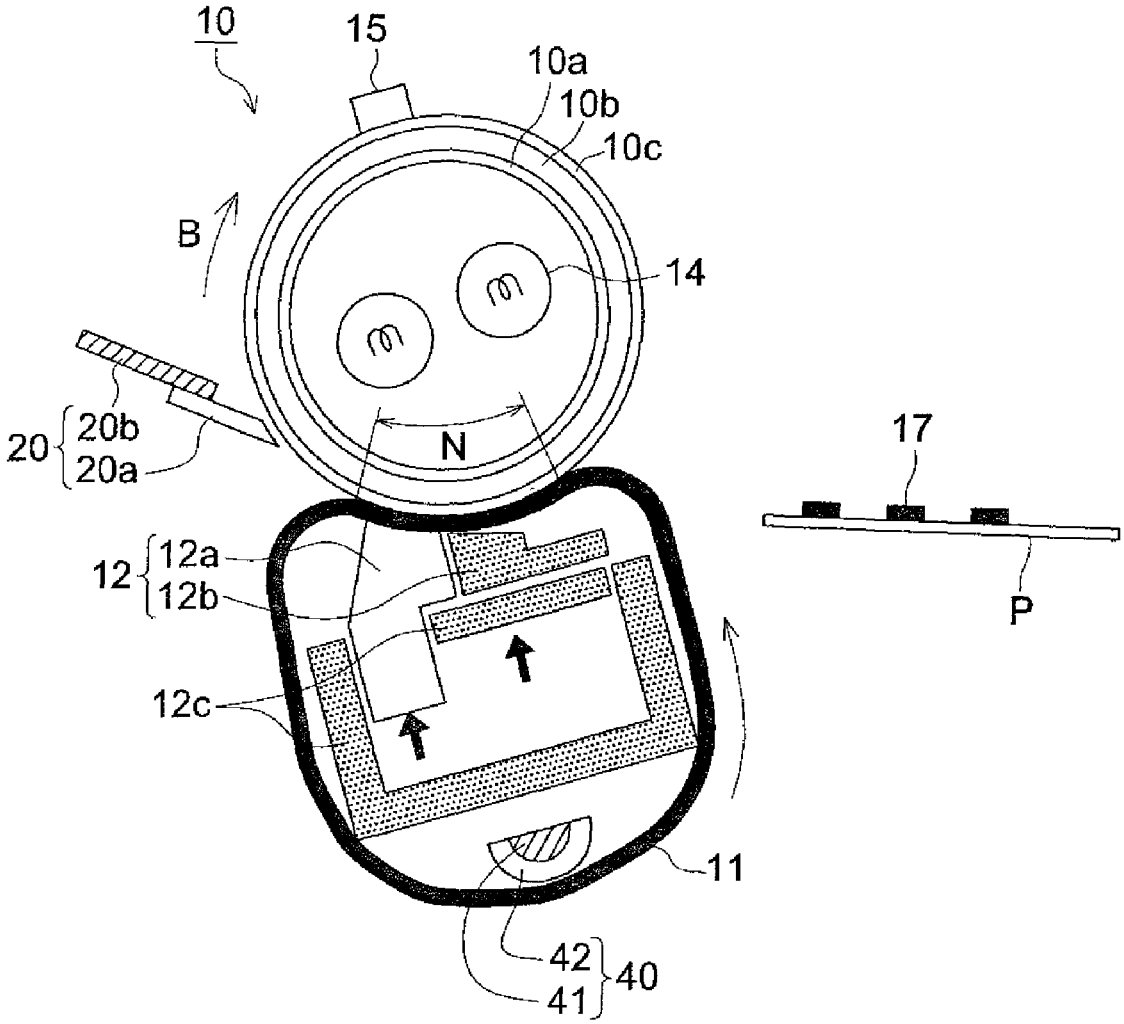
FIG. 3 illustrates an example of a fixing device of a belt-fixing system capable of fixing the toner of the invention.

FIG. 3 illustrates an example of a fixing device of a belt-fixing system capable of fixing the toner of the invention.

A contact-heating fixing device of FIG. 3 is a type of using a belt and a heating roller to create a nip, which is formed mainly of a heating roller 10 pressure belt 11, a pressure pad 12*a* (pressure member) and a pressure pad 12*b* (pressure member), and a lubricant-supplying member 40.

The heating roller 10 is formed of a metal core 10*a* (cylindrical cored bar) having thereon a heat-resistant elastic material layer 10*b* and a releasing layer 10*c* (heat-resistant resin layer), and a halogen lamp 14 as a heating source is disposed inside the core 10*a*. The surface temperature of the pressure belt 11 is measured by a temperature sensor 15 and based on the measured signals, the halogen lamp 14 is feedback-controlled by a temperature controller not shown here, whereby the surface of the pressure roller 11 is controlled to a constant temperature. The pressure belt 11 is pressed to the heating roller 10 to form a nip.

Inside the pressure belt 11, a pressure pad 12 having a low-frictional surface layer is disposed with being pressed to the heating roller 10 through the pressure belt 11. The pressure pad 12 is provided with the pressure pad 12*a* to which a high pressure is applied and the pressure pad 12*b* to which a low pressure is applied and both of which are held by a metal holder 12*c*.

The holder 12*c* is fitted with a belt traveling guide so that the pressures belt 11 slides smoothly against it. The belt traveling guide, which rubs against the inside surface of the pressure belt 11, is preferably a member exhibiting a low friction coefficient and is also preferably low heat-conductive one to make it difficult to conduct heat away from the seamless belt 11.

The heating roller 10 is rotated in the direction of the arrow "B" and the pressure belt 11 is driven by this rotation. A toner image 17 on a transfer material "P" is transferred by a transfer device and the transfer material P is conveyed toward the nip portion from the right-hand side. The toner image 17 on the transfer material P is inserted to the nip portion and fixed by pressure applied in the nip portion aid heat supplied from the halogen lamp 14 through the heating roller 10. Fixing by the device shown in FIG. 3 can have a broad nip portion and achieve stable fixing performance and fixing efficiency.

The fixed transfer material P is released well by the effect of the releasing layer 10*c* and strain in the nip portion without being wound around the heating roller 10. It is desirable to provide a releasing means 20 downstream from the nip portion in the rotating direction of the heating roller 10. The releasing means 20 is constituted of a releasing sheet 20*a* which opposes the rotation direction (reverse) of the heating roller 10 with being in contact with the heating roller and is held by a guide 20*b*.

Next, each constitution will be detailed. The core 10*a* can employ a metal cylinder exhibiting high heat conductivity, such as iron, aluminum or stainless steel. Since the pressure of the pressure pad 12 is relatively low in the fixing device used in the invention, a core 10*a* of a small outer diameter and a small thickness is usable. Specifically, there is usable an iron-made core of 20-35 mm outer diameter and 0.3-0.5 mm thickness. An appropriate size is optimally determined, depending on strength or thermal conductivity of the used material.

The heat-resistant elastic layer 10*b* formed on the surface of the core 10*a* can employ any elastic material exhibiting a relatively high heat resistance. Specifically, an elastic material such as rubber or an elastomer, exhibiting a rubber hardness (JIS-A) of 25-40° is preferred and specific examples thereof include silicone rubber and fluorinated rubber. The thickness of the heat-resistant elastic layer 10*b*, depending on rubber hardness of the used material, is preferably from 0.3 to 1.0 mm.

The fixing device used in the invention can attain abroad nip portion and sufficient fixing performance, and efficient releasing under minimized strain, so that the total load by the pressure pad 12 can be reduced and the thickness of the heat-resistant elastic layer 10*b* can also be reduced. Thus, the fixing device used in the invention allows reduction of the outer diameter and the thickness of the core 10*a* and also allows reduction of the thickness of the heat-resistant elastic layer 10*b* formed on the surface of the core 10*a*, resulting in reduced heat capacity, enhanced instant start capability and/or lowered output of the halogen lamp as a heating source, compared to conventional fixing devices of a paired roller system, and the heat resistance between the inner and outer surfaces can also be reduced, leading to enhanced thermal response. Accordingly, reduction of consumed power and high-speed fixing are realized.

The releasing layer 10*c* (heat-resistant resin layer) formed on the heat-resistant elastic layer 10*b* can use of almost any heat-resistant resin, for example, a fluorinated resin and a silicone resin, of which the fluorinated resin is preferred in terms of releasability or abrasion resistance of the releasing layer 10*c*. Examples of fluorinated resin usable in the invention include PFA (tetrafluoroethylene-perfluoroalkoxyethylene copolymer), PTFE (polytetrafluoroethylene) and PTFE (tetrafluoroethylene-perfluoroalkoxyethylene). Of these, PFA is suitable in terms of heat resistance and workability. The thickness of the releasing layer 10*c* is preferably from 5 to 30μm, and more preferably from 10 to 20μm. A thickness of less than 5μm may cause wrinkling due to strain of the heating roller 10 and a thickness of more than 30 μm hardens the releasing layer 10*c*, leading to possibility of image quality defects such as uneven glossiness. The releasing layer 10*c* can be formed by commonly known methods, such as a dip coating method, a spray coating method, a roll coating method, a bar coating method and a spin coating method.

The pressure belt 11 is preferably constituted of a base layer and a releasing layer on the surface of the base layer (namely, on the side in contact with the heating roller 10 or on both sides thereof). The base layer may be chosen from a polyimide, a polyamide and a polyimideamide, and the thickness thereof is preferably from 50 to 125 μm, and more preferably from 75 to 100μm. The releasing layer formed on the surface of the base layer is preferably a fluorinated resin coating (e.g., PFA) of 5-20μm thickness.

The nip portion preferably has a width so as to have a duel time of the nip portion (an insertion time of transfer material) of not less than 30 msec and preferably from 50 to 70 sec.

In the basic arrangement of the pressure pad 12, the pressure pad 12*b* to secure a wide nip portion is disposed at the inlet side of the nip portion and the pressure pad 12*a* to exert a strong nip pressure against the heating roller 10 is disposed at the outlet side of the nip portion. To minimize slide resistance between the inner circumference of the pressure belt 11 and the pressure pad 12, the pressure pad 12*a* and the pressure pad 12*b* are each provided preferably with a low-friction layer on the side in contact with the pressure belt 11.

In the invention, a lubricant may be supplied between the surface of the pressure pad 12 and the internal surface of the pressure belt 11. For example, silicone oil, fluorinated oil or grease is usable. The lubricant is coated on the internal surface of the belt, but possibly goes around the pressure belt 11 and is adhered to the heating roller, so that a releasable lubricant is desirable. Further, taking account of safety, a silicone oil is preferred rather than a fluorinated oil.

Examples of silicone oil include dimethylsilicone oil, amino-modified silicone oil, carboxy-modified silicone oil, silanol-modified silicone oil and sulfonic acid-modified silicone oil. Of these is preferred an amino-modified silicone oil exhibiting a viscosity of from $5\times10^{-2}$ to 1 $m^2/s$, which can effectively maintain both starting torque and driving torque within a low range and is superior in workability. The lubricant is not consumed but sometimes is carried away when used over a long period of time so that it gradually decreases and finally runs dry, resulting in increased torque. Accordingly, in the invention, a lubricant supplying member 40 to maintain and supply lubricant for the life of the fixing device is provided so that the lubricant does not run dry.

A lubricant maintaining member 41 of the lubricant supplying member 40 is preferably one which has a large number of continuous pores and exhibits an appropriate elasticity as well as heat resistance at the fixing temperature, and including, for example, a felt and a sponge. A lubricant permeation-controlling membrane 42 of the lubricant supplying member 40 is preferably one which has a large number of continuous pores and exhibits a low friction factor as well as heat resistance at a fixing temperature, and, for example, a heat-resistant low-frictional resin which has been subjected to stretch-molding is preferred, specifically preferred is stretch-molded fluorinated resin film.

The lubricant maintaining member 41 is impregnated with lubricant and the lubricant permeation-controlling member 42 of the lubricant supplying member 40 is in contact with the whole region in the axial direction of the pressure belt. Lubricant is supplied to the overall inner circumference of the pressure belt 11 through rotation of the pressure belt 11. A large amount of lubricant need not be supplied so that a contact pressure of the lubricant supplying member 40 to the pressure belt 11 is small to the extent of being only in slight contact.

It is essential to continue to supply a slight amount of lubricant to the inner circumference of the pressure belt 11. The amount of lubricant supplied to the inner circumference of the pressure belt 11 is controlled by varying porosity of the porous lubricant permeation controlling membrane 42 or by controlling the permeating amount of the lubricant in the lubricant permeation-controlling membrane 42.

In the lubricant supplying member 40, the lubricant supplying amount near the central portion in the axial direction of the pressure belt 11 is desirably larger than that near the end portion in the axial direction of the pressure belt 11. This is feasible by making the contact width of the lubricant supplying member 40 near the central potion of the pressure belt 11 broader than that near the end portion, or by making contact pressure of the lubricant supplying member 40 near the central portion stronger than that near the end portion. Broadening the contact width in the central portion of the lubricant supplying member 40 increases the supplying amount. This affects wrinkling of the pressure belt 11 at the time of rotation. When the belt speed in the central portion is larger than that in the end portion, no wrinkling occurs, but when the belt speed in the central portion is smaller than that in the end portion, wrinkling occurs. Accordingly, supplying a larger amount of lubricant to the central portion than the end potion renders running in the belt central portion easier, leading to prevention of wrinkling.

The lubricant supplying member 40 is fitted on the outer surface of a belt running guide and is weakly in contact with the inner circumference of the pressure belt 11. The lubricant supplying member 40 is disposed near the nip inlet. At the nip inlet side, since rotation of the pressure belt 11 applies force of pressing belt to the belt running guide, the belt is pressed by the lubricant supplying member 40.

The nip width formed by the pressure belt and the heating roller is typically from 5 to 40 mm, and preferably from 10 to 30 mm.

A nip width falling within this range allows the fixing temperature to be lower and the initial speed from switch-on of a power source to the start of printing to be faster.

There will be described image forming apparatus.

The image forming apparatus used in the invention comprises at least a charging means for electrostatically charging the surface of a photoreceptor, an exposure means for exposings the charged photoreceptor to form an electrostatic latent image, a development means for developing the electrostatic latent image on the photoreceptor to form a toner image, a primary transfer means for transferring the toner image on the photoreceptor to an intermediate transfer material, a secondary transfer means for transferring the toner image transferred onto the intermediate transfer material to a recording medium, and a means for heat-fixing the toner image transferred onto the recording medium by using a contact heat-fixing device comprised of a heating roller and a pressure roller.

In addition to the foregoing means, the image forming apparatus is provided preferably with a cleaning means for cleaning the intermediate transfer material and a means for coating the photoreceptor surface with a lubricant.

Figure 4:
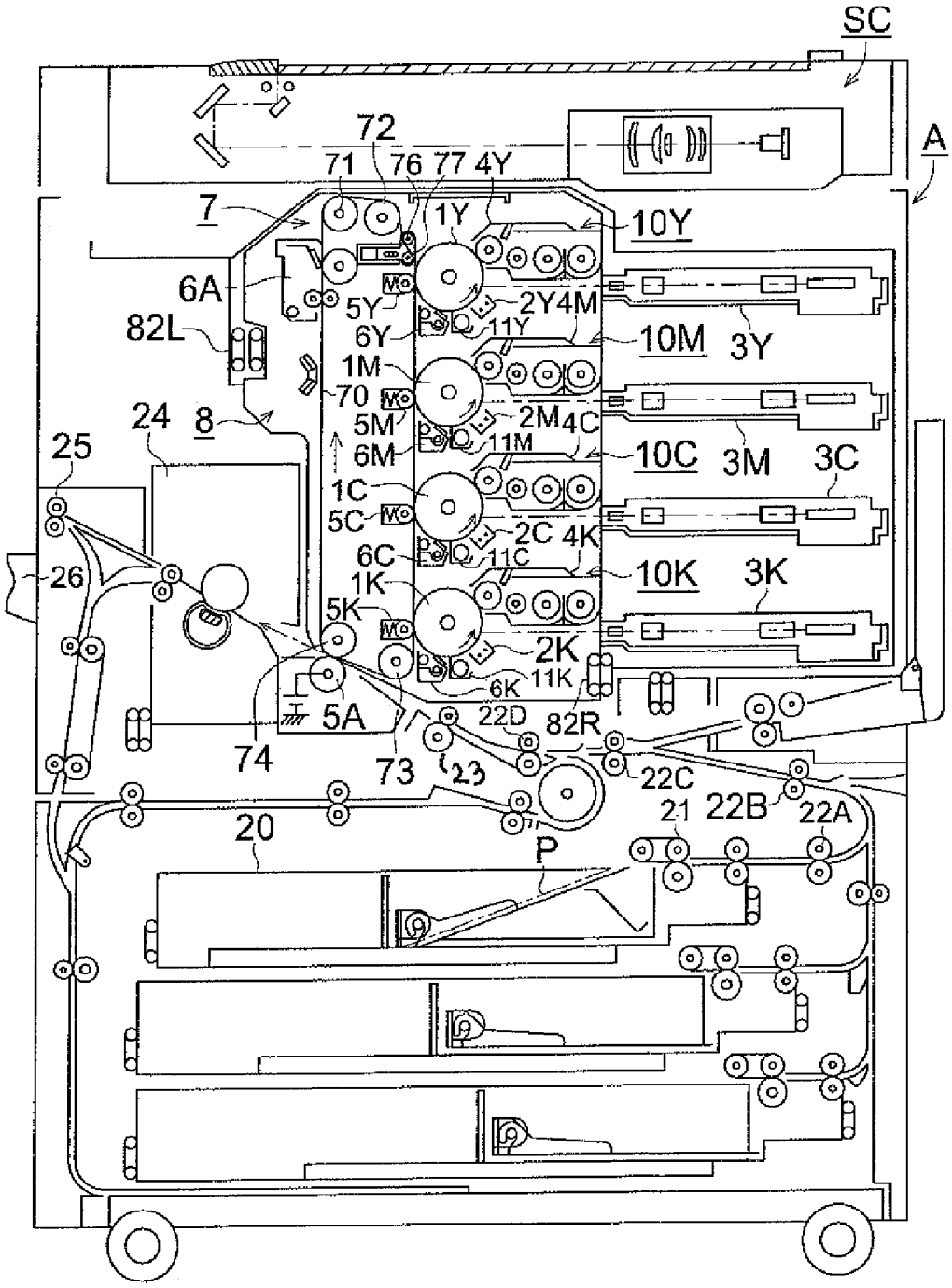
FIG. 4 illustrates a sectional view of an example of an image forming apparatus.

FIG. 4 illustrates a sectional view of an example of an image forming apparatus.

This image forming apparatus is called a tandem color image forming apparatus, which is, as a main constitution, composed of plural image forming sections 10Y, 10M, 10C and 10K, an intermediate transfer material unit 7 as a transfer section including an endless belt form of a transfer belt, paper feeding and conveying means 22A to 22D to convey recording member P and heated roll-type fixing device 24 as a fixing means. Original image reading device SC is disposed in the upper section of image forming apparatus body A.

Image forming section 10Y to form a yellow image as one of different color toner images formed on the respective photoreceptors comprises drum-form photoreceptor 1Y as the first photoreceptor; electrostatic-charging means 2Y, exposure means 3Y and developing means 4Y which are disposed around the photoreceptor 1Y; primary transfer roller 5Y as a primary transfer means; and cleaning means 6Y.

Image forming section 10M to form a magenta image as one of different color toner images formed on the respective photoreceptors comprises drum-form photoreceptor 1M as the second photoreceptor; electrostatic-charging means 2M, exposure means 3M and developing means 4M which are disposed around the photoreceptor 1M; primary transfer roller 5M as a primary transfer means; and cleaning means 6M.

Image forming section 10C to form a cyan image as one of different color toner images formed on the respective photoreceptors comprises drum-form photoreceptor 1C as the third photoreceptor; electrostatic-charging means 2Y, exposure means 3C and developing means 4C which are disposed around the photoreceptor 1C; primary transfer roller 5C as a primary transfer means; and cleaning means 6C.

Image forming section 10K to form a black image as one of different color toner images formed on the respective photoreceptors comprises drum-form photoreceptor 1K as the fourth photoreceptor; electrostatic-charging means 2K, exposure means 3K and developing means 4K which are disposed around the photoreceptor 1K; primary transfer roller 5K as a primary transfer means; and cleaning means 6K.

Intermediate transfer unit 7 of an endless belt form is turned by plural rollers has intermediate transfer material 70 as the second image carrier of an endless belt form, while being pivotably supported.

The individual color images formed in image forming sections 10Y, 10M, 10C and 10K are successively transferred onto the moving intermediate transfer material (70) of an endless belt form by primary transfer rollers 5Y, 5M, 5C and 5K, respectively, to form a composite color image. Recording member P of paper or the like, as a final transfer material housed in paper feed cassette 20, is fed by paper feed and conveyance means 21 and conveyed to secondary transfer roller 5A through plural intermediate rollers 22A, 22B, 22C and 22D and resist roller 23, and color images are transferred together on recording member P. The color image-transferred recording member (P) is fixed by heat-roll type fixing device 24, nipped by paper discharge roller 25 and put onto paper discharge tray outside a machine.

After a color image is transferred onto recording member P by secondary transfer roller 5A, intermediate transfer material 70 which separated recording member P removes any residual toner by cleaning means 6A.

The primary transfer roller 5K is always compressed to the photoreceptor 1K. Other primary rollers 5Y, 5M and 5C are each the photoreceptors 1Y, 1M and 1C, respectively, only when forming color images.

Secondary transfer roller 5A is compressed onto intermediate transfer material 70 only when recording member P passes through to perform secondary transfer.

Housing 8, which can be pulled out from the apparatus body (A) through supporting rails 82L and 82R, is comprised of image forming sections 10Y, 10M, 10C and 10K and the intermediate transfer unit (7) of an endless belt form.

Figure 2:
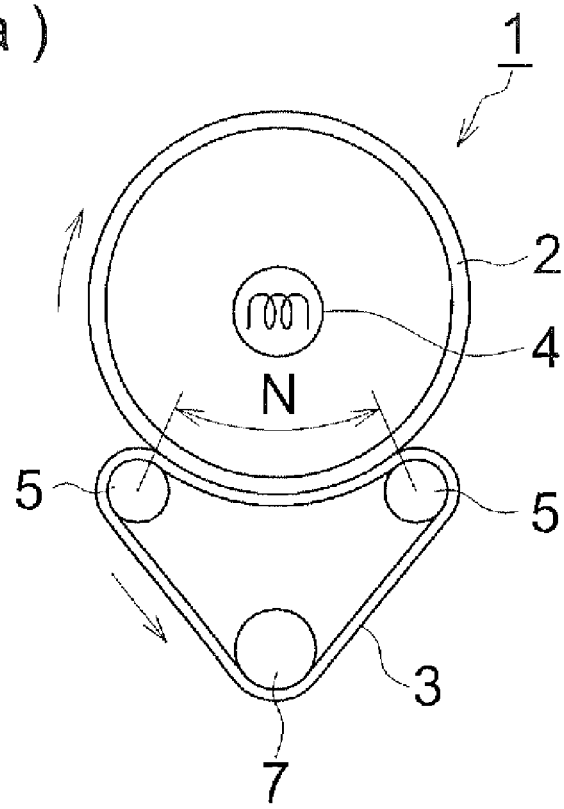
FIGS. 2*a* and 2*b* illustrate an example of a contact-heating fixing device having a heating roller and a belt-form heating means.
Figure 2:
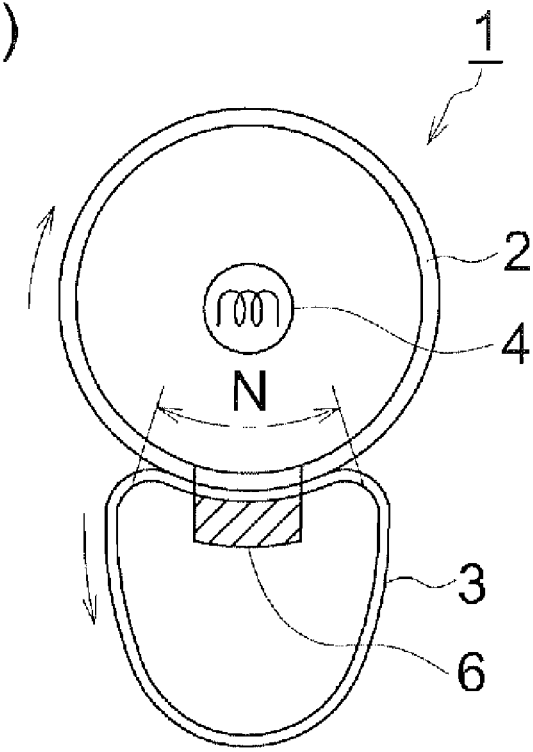

Image forming sections are arranged vertically in a line. Intermediate transfer material unit 7 of an endless belt form is disposed on the left side of photoreceptors 1Y, 1M, 1C and 1K, as indicated in FIG. 2. Intermediate transfer material unit 7 comprises the intermediate transfer unite (7) of an endless belt form which can be turned via rollers 71, 72, 73, 74 and 76, primary transfer rollers 5Y, 5M, 5C and 5K and cleaning means 6A.

The image forming sections 10Y, 10M, 10C and 10K and the intermediate transfer unit 7 are pulled out of the body A by pulling the housing 8.

In the process of image formation, toner images are formed on photoreceptors 1Y, 1M, 1C and 1K, through electrostatic-charging, exposure and development, toner images of the individual colors are superimposed on the endless belt form, intermediate transfer material (70), transferred together onto recording member P and fixed by compression and heating in heat-roll type fixing device 24. After completion of transferring a toner image to recording member P, intermediate transfer material 70 cleans any toner remained on the intermediate transfer material by cleaning device 6A and then goes into the foregoing cycle of electrostatic-charging, exposure and development to perform the subsequent image formation.

In the image forming apparatus, the process speed is 220 mm/s for A4 sheet, a primary transfer roller is a 20 mm diameter sponge roller exhibiting a resistance value of $1\times10^7\Omega$ and transfer control is voltage control. At the time of full-color mode, as shown in the sectional view of FIG. 2, the photoreceptors 1Y, 1M, 1C and 1K.

In the image forming apparatus, an elastic blade is used as a cleaning member of the cleaning means 6A to clean the intermediate transfer material.

EXAMPLES

The invention will be described with reference to examples but the embodiments of the invention are by no means limited to these.

Toner

Toners were prepared in the manner described below.

Preparation of Particulate Hybrid Resin (1):

To 240 g of water containing 2 g of dodecylbenzenesulfonic acid were added 32 g (139 mmol) of azelaic acid, 28 g (139 mmol) of 1,10-decanediol, 80 g of styrene and 20 g of butyl acrylate and dispersed in an ultrasonic dispersing machine to form oil droplets, and then the reaction mixture was allowed to react for 24 hrs. at 95° C. to obtain a polyester resin. At this point of time, the obtained polyester resin was subjected to a molecular weight measurement, and exhibiting 20,000 of a weight average molecular weight (Mw) determined by GPC, 10,000 of a number average molecular weight (Mn), a glass transition temperature (Tg) of 60° C. and a softening point of 125° C. Subsequently, the temperature was lowered to 80° C. and an aqueous solution containing 1.5 g of potassium persulfate was added thereto and reacted for 5 hrs. with supplying radicals from the aqueous medium to obtain a styrene-acryl resin. Particulate hybrid resin (1) was thus prepared.

A styrene-acryl resin separated from the hybrid resin was measured with respect to molecular weight, exhibiting 52,000 of a weight average molecular weight (Mw) determined by GPC, 9,000 of a number average molecular weight (Mn), 5.7 of a molecular weight distribution (Mw/Mn), a glass transition temperature (Tg) of 53° C. and a softening point of 118° C. The particulate hybrid resin (1) exhibited a number average primary particle size of 210 nm.

Preparation of Particulate Hybrid Resin (2):

To 240 g of water containing 3 g of dodecylbenzenesulfonic acid were added 22 g (54 mmol) of polyoxyethylene (2,2) -2,2-bis(4-hydroxyphenyl)propane, 1.2 g (10 mmol) of neopentyl glycol, 10 g of terephthalic acid and 0.6 g of isophthalic acid (for a total of 64 mmol), 80 g of styrene and 20 g of 2-ethylhexyl acrylate with heating at 95° C., and dispersed in an ultrasonic dispersing machine to form oil droplets, and then the reaction mixture was allowed to react for 36 hrs. to obtain a polyester resin. At this point of time, the obtained polyester resin was subjected to a molecular weight measurement, and exhibiting 30,000 of a weight average molecular weight (Mw) determined by GPC, 9,000 of a number average molecular weight (Mn), a glass transition temperature (Tg) of 52° C. and a softening point of 117° C. Subsequently, the temperature was lowered to 80° C. and an aqueous solution containing 1.5 g of potassium persulfate was added thereto and reacted for 5 hrs. with supplying radicals from the aqueous medium to form a styrene-acryl resin. Particulate hybrid resin (2) was thus obtained.

A styrene-acryl resin moiety separated from the hybrid resin was measured with respect to molecular weight, and exhibiting a weight average molecular weight (Mw) determined by GPC of 53,000, a number average molecular weight (Mn) of 8,500, a molecular weight distribution (Mw/Mn) of 6.27, a glass transition temperature (Tg) of 51° C. and a softening point of 114° C. The particulate hybrid resin (2) exhibited a number average primary particle size of 230 nm.

Preparation of Particulate Hybrid Resin (3):

To 240 g of water containing 3 g of dodecylbenzenesulfonic acid were added 22 g (54 mmol) of polyoxyethylene (2,2)-2,2-bis(4-hydroxyphenyl)propane, 1.2 g (10 mmol) of neopentyl glycol, 9.5 g of terephthalic acid and 0.5 g of isophthalic acid (60 mmol in total), 0.5 g (2 mmol) of trimellitic acid, 80 g of styrene and 20 g of butyl acrylate with heating at 95° C., and dispersed in an ultrasonic dispersing machine to form oil droplets, and then the reaction mixture was allowed to react for 24 hrs. at 95° C. to obtain a polyester resin. At this point of time, the obtained polyester resin was subjected to a molecular weight measurement, and 50,000 of a weight average molecular weight (Mw) determined by GPC, 5,000 of a number average molecular weight (Mn), a glass transition temperature (Tg) of 56° C. and a softening point of 120° C. Subsequently, the temperature was lowered to 80° C. and an aqueous solution containing 1.5 g of potassium persulfate was added thereto and reacted for 5 hrs. with supplying radicals from the aqueous medium to obtain a styrene-acryl resin. Particulate hybrid resin (3) was thus prepared.

A styrene-acryl resin moiety separated from the hybrid resin was measured with respect to molecular weight, and exhibiting 53,000 of a weight average molecular weight (Mw) determined by GPC, 8,500 of a number average molecular weight (Mn), a molecular weight distribution (Mw/Mn) of 6.27, a glass transition temperature (Tg) of 51° C. and a softening point of 114° C. The particulate hybrid resin (3) exhibited a number average primary particle size of 210 nm.

Preparation of Colorant Dispersion (1):

In 30 ml of deionized water was dissolved with stirring 1.0 g of an anionic surfactant sodium dodecylbenzenesulfonate. To this solution was gradually added 7 g of carbon black as a colorant, Regal Black 330R (produced by Cabot Co.) and then dispersed by using mechanical dispersing machine, CLEAR MIX (produced by M-Technique Co., Ltd.) to prepare a dispersion (1) of colorant particles [herein after, also denoted as a colorant dispersion (1)]. The particle size of colorant particles of the colorant dispersion (1) was measured by using an electrophoresis light-scattering photometer, ELS-800 (produced by Otsuka Denshi Co.) and the mass average particle size was 92 nm.

Preparation of Colorant Dispersion (2):

Colorant dispersion (2) was prepared similarly to the foregoing colorant dispersion (1), provided that 7 g of carbon black was replaced by 8 g of C.I. Pigment Yellow 185. The particle size of colorant particles of the colorant dispersion (2) was measured by using an electrophoresis light-scattering photometer, ELS-800 (produced by Otsuka Denshi Co.) and the mass average particle size was 87 nm.

Preparation of Colorant Dispersion (3):

Colorant dispersion (3) was prepared similarly to the foregoing colorant dispersion (1), provided that 7 g of carbon black was replaced by 8 g of quinacridone magenta pigment, C.I. Pigment Red 122. The particle size of colorant particles of the colorant dispersion (3) was measured by using an electrophoresis light-scattering photometer, ELS-800 (produced by Otsuka Denshi Co.) and the mass average particle size was 90 nm.

Preparation of Colorant Dispersion (4):

Colorant dispersion (4) was prepared similarly to the foregoing colorant dispersion (1), provided that 7 g of carbon black was replaced by 7 g of phthalocyanine cyan pigment C.I. Pigment Blue 15:3. The particle size of colorant particles of the colorant dispersion (4) was measured by using an electrophoresis light-scattering photometer, ELS-800 (produced by Otsuka Denshi Co.) and the mass average particle size was 90 nm.

Preparation of Wax Dispersion (1):

In 30 ml of deionized water was dissolved 1.0 g of anionic surfactant, sodium dodecylbenzenesulfonate. This solution was heated to 90° C. Then, 7 g of carnauba wax (purified carnauba wax No. 1) melted at 90° C. was gradually added thereto with stirring, dispersed at 90° C. for 7 hrs. in a mechanical dispersing machine, CLEAR MIX (produced by M-Technique Co., Ltd.) and cooled to 30° C. to prepare was wax dispersion (1). The particle size of wax particles of the wax dispersion (1) was measured by using an electrophoresis light-scattering photometer, ELS-800 (produced by Otsuka Denshi Co.), exhibiting a mass average particle size of 95 nm.

Preparation of Wax Dispersion (2):

In 30 ml of deionized water was dissolved 1.0 g of anionic surfactant, sodium dodecylbenzenesulfonate. This solution was heated to 90° C. Then, 7 g of pentaerythritol behenic acid ester as wax, melted at 90° C. was gradually added thereto with stirring, dispersed at 90° C. for 7 hrs. in a mechanical dispersing machine, CLEAR MIX (produced by M-Technique Co., Ltd.) and cooled to 30° C. to prepare was wax dispersion (2). The particle size of wax particles of the wax dispersion (2) was measured by using an electrophoresis light-scattering photometer, ELS-800 (produced by Otsuka Denshi Co.), exhibiting are mass average particle size of 96 nm.

Preparation of Wax Dispersion (3):

In 30 ml of de-ionized water was dissolved 1.0 g of anionic surfactant, sodium dodecylbenzenesulfonate. This solution was heated to 90° C. Then, 7 g of Fischer Tropsch wax as wax, melted at 90° C. was gradually added thereto with stirring, dispersed at 90° C. for 7 hrs. in a mechanical dispersing machine, CLEAR MIX (produced by M-Technique Co., Ltd.) and cooled to 30° C. to prepare was wax dispersion (3). The particle size of wax particles of the wax dispersion (3) was measured by using an electrophoresis light-scattering photometer, ELS-800 (produced by Otsuka Denshi Co.), exhibiting a mass average particle size of 91 nm.

Preparation of Colored Particles (K1):

Into a reaction vessel (four-necked flask) fitted with a temperature sensor, a condenser, a nitrogen introducing device and a stirrer were placed the hybrid resin particles (1), 30 parts by mass of deionized water, the colorant dispersion (1) and the wax dispersion (1). After adjusting the internal temperature to 30° C., an aqueous 5N sodium hydroxide solution was added to this dispersion for coagulation to adjust the pH to 10.0. Subsequently, an aqueous solution of 1 part by mass of magnesium chloride hexahydrate dissolved in 20 ml of deionized water was added with stirring at 30° C. over a period of 10 min. After being allowed to stand for 1 min., the temperature was raised again and this association system was heated to 90° C. over a period of 10 min. Stirring was conducted by using a stirring device, as shown in FIG. 1.

While maintaining the above state, the particle size of coagulated particles was measured by FPIA 2000 and when the volume-based median diameter ($D_{50}$) reached 5.2μm, an aqueous solution of 2 parts by mass of sodium chloride dissolved in 20 ml of deionized water was added to terminate particle growth. After further stirring for 10 hrs with heating at 95° C. to allow continuous melting to control the particle shape, the system was cooled to 30° C., and hydrochloric acid was added thereto to adjust the pH to 2.0 and stirring was stopped.

The thus prepared particles were filtered and repeatedly washed with deionized water of 45° C., and then dried by hot air of 40° C. to obtain colored particles (K1)

Preparation of Colored Particles (K2):

Colored particles (K2) were prepared similarly to the foregoing colored particles (K1), provided that the hybrid resin particles (1) was replaced by the hybrid resin particles (2), the wax dispersion (1) was replaced by the wax dispersion (2), the pH of the dispersion mixture was adjusted to 11.0 and when the volume-based median diameter ($D_{50}$) reached 5.5μm, particle growth was terminated.

Preparation of Colored Particles (K3):

Colored particles (K3) were prepared similarly to the foregoing colored particles (K1), provided that the hybrid resin particles (1) was replaced by the hybrid resin particles (3), the wax dispersion (1) was replaced by the wax dispersion (3), the pH of the dispersion mixture was adjusted to 10.5 and when the volume-based median diameter ($D_{50}$) reached 5.5μm, particle growth was terminated.

Preparation of Colored Particles (Y1):

Colored particles (Y1) were prepared similarly to the colored particles (K1), provided that the colorant dispersion (1) was replaced by the colorant dispersion (2) and when the volume-based median diameter ($D_{50}$) reached 5.5 μm, particle growth was terminated.

Preparation of Colored Particles (Y2):

Colored particles (Y2) were prepared similarly to the colored particles (K2), provided that the colorant dispersion (1) was replaced by the colorant dispersion (2), the pH of the dispersion mixture was adjusted to 9.0 and when the volume-based median diameter ($D_{50}$) reached 5.4 μm, particle growth was terminated.

Preparation of Colored Particles (Y3):

Colored particles (Y3) were prepared similarly to the colored particles (K3), provided that the colorant dispersion (1) was replaced by the colorant dispersion (2) and when the volume-based median diameter ($D_{50}$) reached 5.3 μm, particle growth was terminated.

Preparation of Colored Particles (M1):

Colored particles (M1) were prepared similarly to the colored particles (K1), provided that the colorant dispersion (1) was replaced by the colorant dispersion (3) and when the volume-based median diameter ($D_{50}$) reached 5.5 μm, particle growth was terminated.

Preparation of Colored Particles (M2):

Colored particles (M2) were prepared similarly to the colored particles (K2), provided that the colorant dispersion (1) was replaced by the colorant dispersion (3), the pH of the dispersion mixture was adjusted to 9.0 and when the volume-based median diameter ($D_{50}$) reached 5.4 μm, particle growth was terminated.

Preparation of Colored Particles (M3):

Colored particles (M3) were prepared similarly to the colored particles (K3), provided that the colorant dispersion (1) was replaced by the colorant dispersion (3) and when the volume-based median diameter ($D_{50}$) reached 5.3 μm, particle growth was terminated.

Preparation of Colored Particles (C1):

Colored particles (C1) were prepared similarly to the colored particles (K1), provided that the colorant dispersion (1) was replaced by the colorant dispersion (4) and when the volume-based median diameter ($D_{50}$) reached 5.5 μm, particle growth was terminated.

Preparation of Colored Particles (C2):

Colored particles (C2) were prepared similarly to the colored particles (K2), provided that the colorant dispersion (1) was replaced by the colorant dispersion (4), the pH of the dispersion mixture was adjusted to 9.0 and when the volume-based median diameter ($D_{50}$) reached 5.4 μm, particle growth was terminated.

Preparation of Colored Particles (C3):

Colored particles (C3) were prepared similarly to the colored particles (K3), provided that the colorant dispersion (1) was replaced by the colorant dispersion (4) and when the volume-based median diameter ($D_{50}$) reached 5.3 μm, particle growth was terminated.

Preparation of Toner:

To 100 parts by mass of each of 16 kinds of colored particles (K1) through colored particles (C3) were added 1.0 part by mass of silica exhibiting a number average primary particle size of 12 nm and a hydrophobicity degree of 80 and 1.0 part by mass of titania exhibiting a number average primary particle size of 25 nm and a hydrophobicity degree of 80, and mixed by using HENSCHEL Mixer, whereby each of toners (K1)-(C3) was obtained.

Addition of external additives caused no change in shape and diameter of the toner particles constituting these toners.

Preparation of Comparative Toner (K4):

Into a round bottom flask fitted with a thermometer, a stainless steel stirrer, a nitrogen gas introducing glass tube and a falling film condenser were placed 299 parts by mass of terephthalic acid, 211 parts by mass of polyoxypropylene (2,2)-2,2-bis(4-hydroxyphenyl)propane and 82 parts by mass of pentaerythritol, then, the flask was set to a mantle heater and the temperature was raised, while maintaining in the inside of the flask an inert atmosphere of of nitrogen gas which was introduced through the nitrogen gas feeding tube. Then, 0.05 part by mass of dibutyltin oxide was added and while tracing the reaction based on softening point, reaction was undergone at 200° C., whereby polyester resin A having a chloroform insoluble content of 17% by mass was prepared. This polyester resin A exhibited a glass transition temperature of 59° C. and a softening point of 131° C.

To 100 parts by mass of the polyester resin A were added 90 parts by mass of a styrene-acryl resin (composed of a styrene-derived component and butyl acrylate-derived component at a mass ratio of 72:28 and exhibiting a glass transition temperature of 53° C. and a softening point of 121° C.), 6 parts by mass of carbon black and 6 parts by mass of pentaerythritol behenic acid ester and then mixed, kneaded, cooled, ground and classified, whereby comparative colored particles (K4) exhibiting a volume-based median diameter ($D_{50}$) of 6.8 μm were obtained. Further thereto were added 1.0 part by mass of silica exhibiting a number average primary particle size of 12 nm and a hydrophobicity degree of 80 and 1.0 part by mass of titania exhibiting a number average primary particle size of 25 nm and a hydrophobicity degree of 80 and then mixed by HENSCHELL Mixer, whereby comparative toner (K4) was obtained.

Preparation of Comparative Toner (Y4):

Comparative toner (Y4) exhibiting a volume-based median diameter ($D_{50}$) of 6.4 μm was prepared similarly to the foregoing comparative toner (K4), provided that carbon black was replaced by 8 parts by mass of pigment C.I. Pigment Yellow 185.

Preparation of Comparative Toner (M4):

Comparative toner (M4) exhibiting a volume-based median diameter ($D_{50}$) of 6.4 μm was prepared similarly to the foregoing comparative toner (K4), provided that carbon black was replaced by 9 parts by mass of quinacridone magenta pigment C.I. Pigment Red 122.

Preparation of Comparative Toner (C4):

Comparative toner (C4) exhibiting a volume-based median diameter ($D_{50}$) of 6.4 μm was prepared similarly to the foregoing comparative toner (K4), provided that carbon black was replaced by 9 parts by mass of phthalocyanine cyan pigment C.I. Pigment Blue 15:3.

Resins used for preparation of toners, preparation methods thereof and volume-based median diameters ($D_{50}$) of the obtained toners are shown in Table 1.

TABLE 1

| Toner | | | |
|---|---|---|---|
| Toner No. | Resin | Preparation Method | $D_{50}$ (μm) |
| K1 | Hybrid resin (1) | Polymerization | 5.2 |
| K2 | Hybrid resin (2) | Polymerization | 5.5 |
| K3 | Hybrid resin (3) | Polymerization | 5.5 |
| K5 | Styrene-Acryl resin + Polyester resin | Grinding | 6.8 |

The volume-based median diameter ($D_{50}$) of toner particles can be determined using Coulter Multisizer 3 (Beckmann Coulter Co.), connected to a computer system for data processing.

Developer

Twelve developers (K1) to (C3) and four comparative developers (K4) to (C4) were each prepared by mixing 16 parts by mass of each of twelve toners (K1) to (C3) and four comparative toners (K4) to (C4) and 400 parts by mass of an acryl resin-coated ferrite carrier having a volume-based median diameter of 45 μm.

As an image forming apparatus was used a tandem full-color copier, "8050" (produced by Konica Minolta Business Technologies Inc.) installed with a contact-heating fixing device constituted of a heating roller and a pressure belt, as shown in FIG. 3, under the conditions described below:

Heating roller: a roller coated with a 30 μm thick tetrafluoroethylene layer on the surface of an iron cylinder, Pressure belt: a silicone rubber-coated belt having 200 μm conductive material dispersed on the surface of a 70μm thick polyimide film, Heat source: halogen lamp, Surface temperature of the heating roller: 140° C., Total pressure between the heating roller and the heating belt: 15 kg, Nip width: 15 mm Evaluation Printing was conducted by loading each of the toners into the image forming apparatus and prints were evaluated with respect to the following items, based on criteria described below, in which grades A, B and C were acceptable in practice, while grade D was unacceptable in practice.

Fixing Offset:

A full-color image (in which picture elements of each of yellow, magenta, cyan and black accounted for 5%) was printed on A4-size fine-quality paper (65 g/m$^2$) and a 50,000-sheet printing-run was continuously conducted under an environment of low temperature and low humidity (10° C. and 20% RH). After completion of pringing of 50,000 sheets, a solid white image was printed and the presence/absence of staining was visually evaluated with respect to fixing offset, and further the presence/absence of toner stain transferred onto the pressure belt was also visually evaluated, based on the following criteria:

A: No staining was observed on the image and nor on the belt surface,

B: No staining was observed on the image but slight staining was observed on the belt surface, D: Staining occurred on the image, the belt surface was stained and stains adhered to the back surface of the image.

Winding:

A full-color image (in which picture elements of each of yellow, magenta, cyan and black accounted for 25% at a pixel factor of 100) was continuously printed on both sides of A4-size fine-quality paper (65 g/m$^2$) under an environment of low temperature and low humidity.

The top of the image was formed within 1 mm from the edge of fine-quality paper, continuous printing of 500 sheets was conducted and the presence/absence of winding onto the pressure belt side was observed and evaluated, based on the following criteria:

B: no winding occurred until the 500th sheet reached,

D: winding onto the pressure belt side occurred before the 500th sheet reached.

Evaluation results are shown in Table 2.

TABLE 2

| | Toner No. | | | | Fixing Device | | Evaluation | |
|---|---|---|---|---|---|---|---|---|
| | | | | | Constitution | Nip Width (mm) | Fixing Offset | Winding |
| Example 1 | K1 | C1 | M1 | Y1 | * | 15 | A | B |
| Example 2 | K2 | C2 | M2 | Y2 | * | 15 | A | B |
| Example 3 | K3 | C3 | M3 | Y3 | * | 15 | A | B |
| Comparison 1 | K4 | C4 | M4 | Y4 | * | 15 | D | D |

* Heating roller and Pressure belt

As apparent from Table 2, it was proved that Examples 1-3 in which toners relating to the invention and a contact fixing device relating to the invention resulted in superior characteristics.

What is claimed is:

1. An image forming method comprising the steps of:

developing an electrostatic latent image formed on a photoreceptor with a developer comprising a toner to form a toner image and transferring the toner image onto a transfer material and fixing the toner image on the transfer material by a fixing device of a contact heat fixing system, wherein the toner comprises toner particles comprising a resin and a colorant and the resin which comprises a polyester resin and a styrene-acryl copolymer resin is formed by a process comprising (i) allowing a polyvalent carboxylic acid and a polyvalent alcohol to polymerize through polycondensation in the presence of a styrene monomer and an acrylic acid ester monomer in an aqueous medium to form the polyester resin and (ii) allowing the styrene monomer and the acrylic acid ester monomer to polymerize through radical polymerization to form the styrene-acryl copolymer resin to form resin particles comprising the polyester and the styrene-acryl copolymer resin;, wherein in step (i), the styrene monomer and the acrylic acid ester monomer are polycondensable monomers and a content of the poly-condensable monomers is from 10 to 90% by mass, based on the whole of a resin forming composition;

the fixing device of a contact heating system comprises a heating roller and a belt-form pressure means.

2. The image forming method of claim 1, wherein prior to (i), a composition of the polyvalent carboxylic acid, the polyvalent alcohol, the styrene monomer and the acrylic acid ester monomer is dispersed in the form of oil droplets dispersed in the aqueous medium.

3. The image forming method of claim 2, wherein the aqueous medium contains an acidic group containing surfactant.

4. The image forming method of claim 3, wherein the surfactant is contained at a concentration of not more than a critical micelle concentration of the surfactant.

5. The image forming method of claim 1, wherein the process further comprises:

(iii) coagulating the resin particles and colorant particles to form the toner particles.

6. The image forming method of claim 1, wherein the toner particles exhibit a volume-based median diameter ($D_{50}$) of 3 to 8 μm.

7. The image forming method of claim 1, wherein the heating roller is comprised of a metal cylindrical metal core having thereon a heat-resistant material layer and further thereon a heat resistant resin layer.

8. The image forming method of claim 1, wherein the belt-form pressure means is a pressure belt comprised of a base layer having thereon a releasing layer.

* * * * *